United States Patent [19]

Weiffen

[11] 4,265,744

[45] May 5, 1981

[54] DISCHARGE-CONTROLLED METHOD FOR A COMPRESSED AIR-CONTROLLED WET SETTLING MACHINE

[75] Inventor: Karl-Heinz Weiffen, Bochum, Fed. Rep. of Germany

[73] Assignee: Klöckner-Humboldt-Deutz AG, Fed. Rep. of Germany

[21] Appl. No.: 126,219

[22] Filed: Mar. 3, 1980

Related U.S. Application Data

[63] Continuation of Ser. No. 930,390, Aug. 2, 1978, abandoned.

[30] Foreign Application Priority Data

Aug. 2, 1977 [DE] Fed. Rep. of Germany ..... 2734736

[51] Int. Cl.[3] ..... B03B 5/22

[52] U.S. Cl. ..... 209/457; 209/491; 209/496; 340/529

[58] Field of Search ..... 209/455–457, 209/427, 484, 489, 490, 491, 495, 496, 503; 210/86; 340/527, 529; 116/227

[56] References Cited

U.S. PATENT DOCUMENTS

| | | | |
|---|---|---|---|
| 2,106,756 | 2/1938 | Obermaier | 340/529 |
| 4,019,981 | 4/1977 | Stern et al. | 209/455 |

FOREIGN PATENT DOCUMENTS

| | | | |
|---|---|---|---|
| 932481 | 9/1955 | Fed. Rep. of Germany . | |
| 811460 | 4/1959 | United Kingdom | 209/489 |

OTHER PUBLICATIONS

BATAC-jigs, Nov. 1974.

Digital Circuit Arrangements, MOS, Data Book 1974/75, vol. 1, Siemens AG.

WEDAG, Elecktronisch Gesteuerte Setzmaschinenventile, Apr. 1969.

*Primary Examiner*—Tim R. Miles

*Attorney, Agent, or Firm*—Hill, Van Santen, Steadman, Chiara & Simpson

[57] ABSTRACT

A discharge-controlled method for a compressed air-controlled wet settling machine for the preparation of mineral mixtures, particularly for the washing of raw coal, is carried out such that the preparation takes place by means of pulsation of a separating liquid in a work chamber, whereby the pulsation is controlled by means of inlet and outlet valves and results in a stratification of the minerals on the settling machine carrier such that the heavier materials are stratified below the lighter materials. The layer level of the heavier material is measured by a scanner, in particular a float, and an actual-reference regulation controls a discharge apparatus for the heavier minerals. Measurement of the actual value of the heavier material layer level takes place by way of the scanner during a period of time which lies asymmetrically between the opening time of the outlet valve and the opening time of the inlet valve, and in particular shortly before the opening time of the inlet valve. The method further includes determining whether the layer level has increased or decreased beyond specific limits and provides optical and/or acoustic signals when such limits are exceeded.

8 Claims, 2 Drawing Figures

DISCHARGE-CONTROLLED METHOD FOR A COMPRESSED AIR-CONTROLLED WET SETTLING MACHINE

This is a continuation of application Ser. No. 930,390, filed Aug. 2, 1978, now abandoned.

BACKGROUND OF THE INVENTION

1. Field of the Invention

The present invention relates to a discharge-controlled method for a compressed air-controlled wet settling machine for the preparation of mineral mixtures, particularly for the washing of raw coal, in which the preparation takes place through pulsation of a separating liquid in a work chamber, whereby the pulsation is controlled by means of inlet and outlet valves and results in a layering of the minerals on the settling material carrier, and more particular to such a method in which the level of the layer of the specific heavy materials in each case is measured by at least one member through which an actual-reference regulation controls a discharge apparatus of the heavier minerals.

2. Description of the Prior Art

From the German Pat. No. 932,481, a method and an apparatus for the regulation of the discharge from wet settling machines are known, in which, through a measuring circuit, and during the time interval in which the heavy mineral layer is in its lower position of rest, the level of the layer is scanned. The switching into circuit of the measuring circuit takes place during a predetermined angle $\alpha$ of the cycle of the rotary-slide inlet and outlet valves in the corresponding operating phase of the settling procedure symmetrically with respect to the movement of the inlet and outlet valves, during the time in which the inlet and outlet valves are closed.

SUMMARY OF THE INVENTION

It is the object of the present invention to improve the aforementioned known method for the regulation of the discharge of a wet settling machine, and particularly to provide a controlled method which permits an increased scanning accuracy, as well as an adaptation of the scanning to the settling behavior of different mineral compositions and grain sizes.

The above object is achieved in that the measuring of the actual value of the layer level takes place by means of a scanning body during a time interval which lies asymmetrically between the opening time of the outlet valve and the opening time of the inlet valve. In particular, this time interval is shortly before the opening of the inlet valve. Through the above measure, it is advantageously possible to improve scanning accuracy. It has been found that, not as assumed with the known discharge-controlled methods, upon disposing of the layer of settling material on the settling seive, a stand-still phase is formed, but that the material movement takes place or follows somewhat a sinusoidal curve. The minimum of the sinusoidal curve lies, in this connection, surprisingly primarily not symmetrically in the center of the time span between closure of the outlet valve and reopening of the inlet valve, but is, in each case according to grain size and mineral composition, more or less moved out of the center and is asymmetrical with respect thereto. With coal of fine granulation, as coal is prepared in fine grain settling machines, for example the procedure until the material comes to rest is retarded, so that in such a case the measuring time interval is positioned advantageously very close to the reopening of the inlet valve for the pulsation air. Beyond this, it was found that frequently a reliable measuring is possible, when the measurment is made not at the moment of the most dense packing, but directly before or particularly thereafter.

In one embodiment of the invention, it is provided that the size of the particular actual value according to the measurement is stored. In this manner, it is advantageously obtained that, even after the very short measuring time, lying for example between 50 and 120 $\mu$sec., (a further shortening is desired), being able to make use of the measuring value for influencing the discharge behavior. This is particularly important when a hydraulic system must be influenced, which compared with electronics operates relatively slowly.

In a further development of the invention, it is provided that the size of the actual value is entered in a limit value control instrument in which predetermined limit values are compared with the actual value. Through this measure, it is advantageously attained, that in the time interval which lies between the measuring time and the point of time of the beginning of opening of the inlet valve or the end of the opening of the outlet valve, respectively, may be supervised in an indirect manner. Upon a shifting of the measuring time space in reference to the opening times, it of course comes to a lasting deviation of the actual value from the reference value, without the other machine data being changed, as scanning no longer takes place in the most favorable packing condition predetermined on the basis of the discharge behavior.

A corresponding limit value control has, in addition, the advantage that all the functions of the discharge apparatus are supervised at the same time. Therefore, both an electrical shifting in the scanning system, as well as a mechanical damage of the scanner, which is constructed as a float, or even a damaging of the discharge system, lead to a lasting shifting of the actual value. The limit value control device controls, accordingly, not only the position of the scanning time interval to the inlet and outlet time intervals, but also all the other portions of the discharge procedure and the discharge appparatus, which may lead to a lasting shifting of the actual value.

In an embodiment of the invention, it is provided that after exceeding the limit values upwardly or downwardly, an optical and/or acoustic signal transmitter is actuated, and that between the limit value control device and the signal transmitter, a time circuit is interposed. By means of this arrangement, it is attained, that exceeding the limit value is reliably imparted to the maintenance personnel and furthermore, that short period of fluctuations in the actual value, even if they exceed the predetermined limit value, are suppressed, and only long-lasting excess values which make necessary and intervention of the maintenance personnel are indicated.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
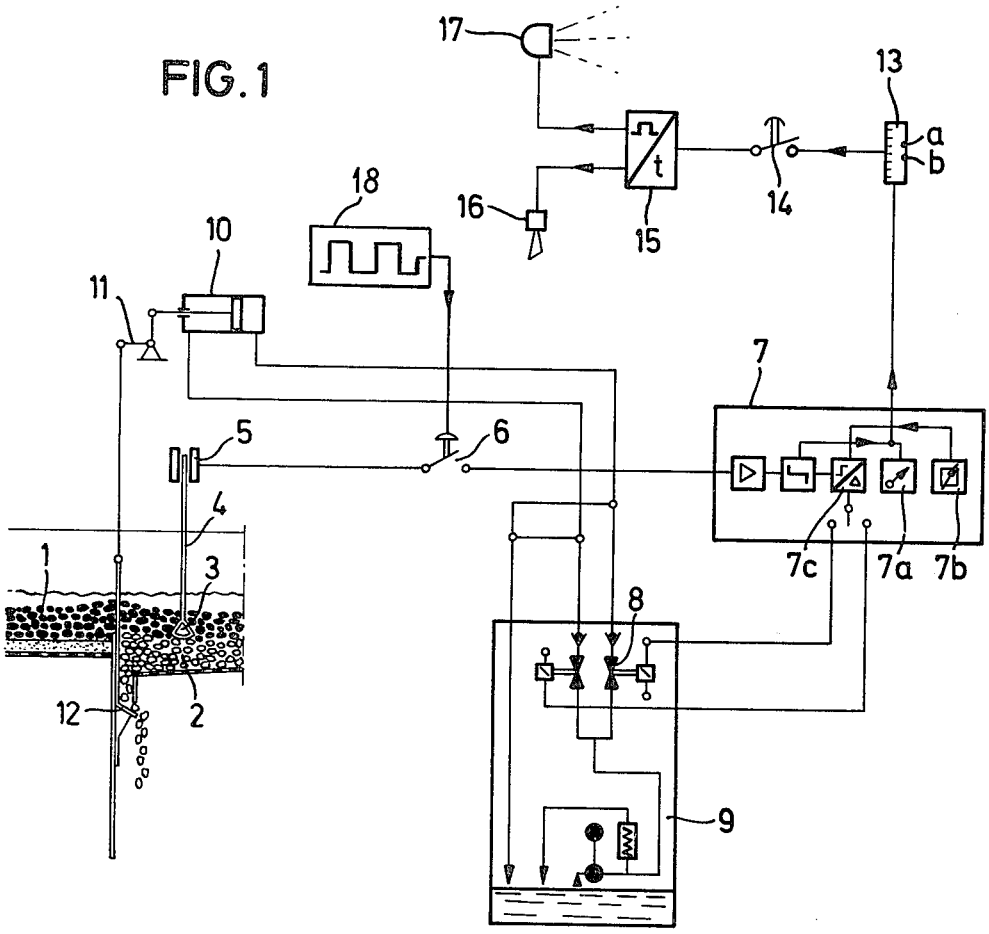
FIG. 1 is an electric-hydraulic schematic circuit diagram of the discharge-controlled system having the pertaining limit value control.

In FIG. 1, a lighter mineral layer 1, for example coal, and a heavier mineral layer 2, for example rocks, are carried on a perforate carrier of a settling machine within a pulsation chamber of the type which is generally known in the art. A scanner, in the form of a float 3, carried by a transfer rod 4, rests on the heavier mineral layer 2. The transfer rod 4 has the upper end thereof disposed within an inductive transmitter 5. The inductive transmitter 5 is connected through an automatic measuring point release, here depicted as a switch 6, to feed the actual position of the float 3 to an electronic control device 7, in which the actual position signal is stored, amplified and fed to an indicating device 7*a*.

The automatic measuring point release 6 is connected by means of an electric signal which is produced in the electronic valve control system 18. The signals of the electronic valve control system 7 are produced through pre-adjustable decade counters, which are controlled by a crystal oscillator generated timing signal in the microsecond range. The elements of the electronic control 7 are commercially available MOS building blocks, such as are known, for example, from the publications V a l v o, Taschenbuch, 1974; "Designing with TTL Integrated Circuits", Anderson et al., McGraw-Hill Book Company, 1971. Texas Instruments Incorporated; and Siemens Aktiengesellschaft, Digitale Schaltungen, MOS Datenbuch, 1974/75, Band 1, and in the general publication covering such devices, entitled Batch-jigs, 4-201e, published in English by KHD Industrieanlagen AG, Humboldt Wedag, November 1974.

In the indication device 7*b*, a reference or theoretical value is generated, which like the actual value, is fed to the actual value-reference value comparison device 7*c*. All of the connection elements, comparison devices, etc., are, as the value control system, constructed as electronic slide-in or plug-in units.

From the actual value-reference value comparison device 7*c* a control signal is emitted from the electronic three-way valves 8, which actuate the hydraulic severomotor 10. The servomotor 10 shifts, with the aid of the lever mechanism 11, the discharge apparatus 12 which is disposed beneath the layer of heavy material 2, and adjusts the discharge as long as and in the direction of the deviation of the actual value from the reference value, until the actual value of the layer level of the heavier materials corresponds with the reference value. The energy for the servomotor 10 is supplied by an oil pump 9 which is driven by an electric motor. This general structure is disclosed in the aforementioned Wedag publication.

Prior to the input of the indication device 7*a*, the actual value is tapped off and supplied to a limit value control device 13. The limit value control device 13 is set with an upper limit and a lower limit which, in the operation of the apparatus, is not to be exceeded or gone below, respectively, for the level of the layer of heavy materials. Upon exceeding the upper or lower limit value 13*a*, 13*b*, the limit value control device 13 generates a signal which, after passing a time delay circuit 14, actuates, through a regulator 15, an acoustic device 16 and/or an optical device 17 which provide alarm signals. Therefore, care is taken for a complete supervision of the discharge system, as each shifting in the scanning system is indicated, whether the indication be in the timewise position with respect to the outlet and/or inlet time interval of the operating air, in the electric-hydraulic transfer system or in the mechanics of the discharge apparatus. Together with the asymmetrically adjusted position of the scanning interval, each according to the requirements of the mineral mixture to be prepared, there results a measurement of the layer level previously unknown as to reliability in accuracy, which leads to a substantial improvement in the discharge behavior of a wet settling machine.

Figure 2:
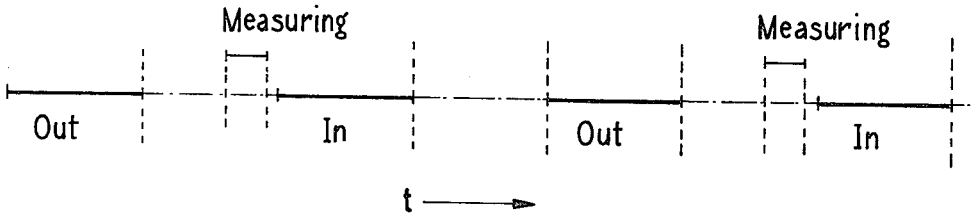
FIG. 2 is a pulse diagram relating the inlet and outlet time intervals to the measuring time intervals of a settling machine operated in accordance with the present invention.

FIG. 2 illustrates, diagrammatically, the timewise sequence of the operating and measuring cycle of a settling machine. The intervals with the designation OUT provide an indication of the opening time for the outlet valves, and the intervals having the designation IN denote the opening times of the inlet valves. The valve operation times do not overlap, but leave therebetween intermediate spaces, in which, after the closure of the outlet valves and before the opening of the inlet valves, an interval MEASURING is disposed for the next pulsation thrust of the measuring period. The measuring period is, as a rule, shorter than the valve opening times and lies asymmetrically in the free interval after closure of the outlet valve and before the opening of the inlet valve.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a discharge control method for controlling a compressed air-controlled settling machine for the preparation of mineral mixtures, in particular the washing of raw coal, in which air inlet and outlet valves are cyclically operated during respective spaced time intervals to introduce and exhaust air from a work chamber in which the mixture is carried on a perforate settling machine carrier to sinusoidally pulsate a separating liquid in the chamber and stratify the mixture into at least heavy and lighter layers of material, and in which a scanner senses the level of the heavy layer and controls a discharge device for controlling the discharge of the heavier layer in accordance with an actual-reference regulation control, the improvement comprising the step of: scanning the heavy layer level and feeding an actual value to the regulation control during a measuring time interval which is asymmetrically time positioned with respect to the maximum density rest time of the material.

2. The improved method of claim 1, wherein the step of scanning and feeding is further defined as, scanning and feeding the actual value signal shortly prior to the opening of the inlet valve.

3. The improved method of claim 1, comprising the further step of:

storing the actual value signal after measuring the heavy level.

4. The improved method of claim 1, comprising the further step of:

comparing the actual value signal with upper and lower limit values.

5. The improved method of claim 4, comprising the further step of:

generating an alarm signal in response to the actual value signal exceeding one of the limit values.

6. The improved method of claim 5, wherein the step of generating is further defined as:

generating an audible alarm.

7. The improved method of claim 5, wherein the step of generating is further defined as:

generating an optical alarm.

8. The improved method of claim 5, comprising the further step of:

prior to generating an alarm signal, delaying an indication of exceeding a limit for a predetermined time to prevent an alarm in response to short-time limit overshoot.

* * * * *